United States Patent [19]

Justice, Sr.

[11] Patent Number: 5,042,185

[45] Date of Patent: Aug. 27, 1991

[54] SEMI-AUTOMATIC PISTOL SAFETY LOCK APPARATUS

[76] Inventor: Jerry P. Justice, Sr., 2164 Warwick, Houston, Tex. 77093

[21] Appl. No.: 517,758

[22] Filed: May 2, 1990

Related U.S. Application Data

[63] Continuation-in-part of Ser. No. 482,652, Feb. 21, 1990, Pat. No. 4,972,618.

[51] Int. Cl.[5] ..... F41A 17/74

[52] U.S. Cl. ..... 42/70.11

[58] Field of Search ..... 42/70.11

[56] References Cited

U.S. PATENT DOCUMENTS

| | | | |
|---|---|---|---|
| 2,945,316 | 7/1960 | Mulno | 42/70.11 |
| 3,462,869 | 8/1969 | Wallace | 42/70.11 |
| 3,882,622 | 5/1975 | Perlotto | 42/70.11 |
| 4,972,618 | 11/1990 | Justice, Sr. et al. | 42/70.11 |

*Primary Examiner*—Richard W. Wendtland

*Attorney, Agent, or Firm*—Pravel, Gambrell, Hewitt, Kimball & Krieger

[57] ABSTRACT

A locking mechanism for a semi-automatic pistol that completely disables the weapon when in the locked position. The mechanism includes a set screw that is inserted in a small hole drilled in the side of the pistol side plate behind the trigger. The set screw has attached to it a small button such that when the mechanism is in a locked position, the button located on the screw is extended into a blind hole formed in the hammer, thereby preventing pivotal movement of the hammer, and consequently preventing operation of the trigger and the slide. When the mechanism is in an unlocked position, the weapon functions as originally intended by the manufacturer.

3 Claims, 2 Drawing Sheets

SEMI-AUTOMATIC PISTOL SAFETY LOCK APPARATUS

This application is a continuation-in-part of co-pending U.S. patent application Ser. No. 482,652 filed Feb. 21, 1990 for Revolver Safety Lock Apparatus now U.S. Pat. No. 4,972,618. The named inventor in this application was a co-inventor in the parent application.

BACKGROUND OF THE INVENTION

1. Field of the Invention

The present invention relates generally to safety devices for firearms, more particularly to a safety locking device for a semi-automatic pistol which may be incorporated into an existing weapon design or, alternatively, may be installed in a premanufactured weapon, wherein the safety locking device includes a mechanism for locking the hammer, thereby locking the trigger and the slide into place and preventing the operation of the pistol.

2. Description of the Prior Art

The desirability of safety mechanisms on firearms has long been recognized and their presence on semi-automatic weapons, such as handguns, as well as on other types of weapons, is common. Typically, these safety mechanisms are simple toggle devices movable between safe and ready positions. In the safe position, the safety acts either to prevent the trigger from being pulled, prevent the hammer from being cocked, or prevent an already cocked hammer from being moved to strike the firing pin. A second type of safety addresses the locking of the slide in an open position when cocking the pistol.

Many of the known patents for safety mechanisms on firearms have utilized some type of hammer-block to prevent the firearm from discharging. However, these safety devices do not prevent the unauthorized use of the firearm. They only act to prevent an accidental discharge of the firearm when the safety is activated. Due to the increasing number of gun-related accidents and deaths occurring nationally, especially those occurring among children, it is desirable that a safety mechanism for a firearm include a locking capability such that the safety mechanism cannot be readily disabled without an external device such as a key. For example, U.S. Pat. No. 2,945,316 discloses a hammer blocking safety for a revolver which is operable by a specially designed key. A spring loaded rod having a hammer block at one end is retained within the revolver handle frame. U.S. Pat. No. 3,462,869 discloses a key operated safety lock device for a revolver wherein a lock cylinder acting as a hammer block is mounted within the frame of the revolver.

Pending U.S. application Ser. No. 482,652, the parent to this application, discloses an internal locking mechanism for a revolver type firearm. The locking mechanism disclosed therein locks the hammer, trigger and cylinder release for a revolver, thereby rendering the firearm inoperable.

The most of the locking devices for revolvers mentioned above, and their corresponding counterparts for semi-automatic pistols, are relatively expensive in that they generally require major modifications to the firearm. These modifications generally alter the appearance of the firearm to a noticeable degree. It is an object of the present invention to provide a reliable safety lock for a semi-automatic firearm capable of disabling the weapon when in the locked position. Furthermore, it is desireable for the safety lock to be adaptable to premanufactured firearms without appreciable cost and with minimal modification to the weapon. The present invention may be incorporated into an existing weapon design and manufactured with the present invention built into the weapon.

SUMMARY OF THE INVENTION

The present invention is directed to a locking mechanism for a semi-automatic pistol which locks the hammer in a closed or "safe" position. As a result, the trigger and the slide are also locked in a safe position. When the locking apparatus is set to a locked position, the pistol is completely inoperable and virtually tamper proof. Furthermore, the installation of the present invention requires minimal modification to a premanufactured weapon and may also be easily incorporated into an existing weapon design.

In the instance of a premanufactured weapon, a small hole is drilled in the side of the side of the firearm side plate above the grip and adjacent to the hammer. The hole is threaded and includes a internal small counterface adapted to receive a locking pin. The locking pin is comprised of a set screw having threads which match those in the side plate hole and a flat cylindrical button attached to the set screw. The locking pin is adapted to fit flush within the counterface when the set screw is fully retracted. The set screw has a selected drive or locking means, e.g., an allen drive, star drive, phillips drive, etc., that is removable from the locking pin. A blind hole is drilled in the hammer coaxial to the side plate hole, when the hammer is in the safe position, and is adapted to receive the flat cylindrical button when the locking mechanism is engaged.

The safety apparatus according to the present invention is placed in a locked position by placing the hammer into the closed or safe position rotating the set screw clockwise utilizing the selected drive means, thereby extending the cylindrical button into the blind hole formed in the hammer. The cylindrical button engages and locks the hammer, preventing rotational movement of the hammer and, consequently, preventing movement of the trigger. Furthermore, as a consequence of the hammer being locked, the slide may not be pulled back, rendering it impossible for a cartridge from the magazine to be chambered into the weapon. To unlock the weapon from the locked position to the unlocked position, the selected drive means is used to rotate the locking pin set screw counterclockwise to retract the button from the blind hole in the hammer to the counterface formed in the side plate.

Therefore, the safety locking apparatus according to the present invention virtually disables the weapon when in the locked position. The weapon remains disabled until the removable drive means is applied to the locking pin to unlock the weapon. When the safety mechanism is in the unlocked position, the weapon functions as originally intended by the manufacturer.

BRIEF DESCRIPTION OF THE DRAWINGS

A better understanding of the invention can be obtained when the following detailed description of the preferred embodiment is considered in conjunction with the following drawings, in which.

DETAILED DESCRIPTION OF THE PREFERRED EMBODIMENT

This is a continuation-in-part of co-pending application Ser. No. 482,652 filed Feb. 21, 1990.

Figure 1:
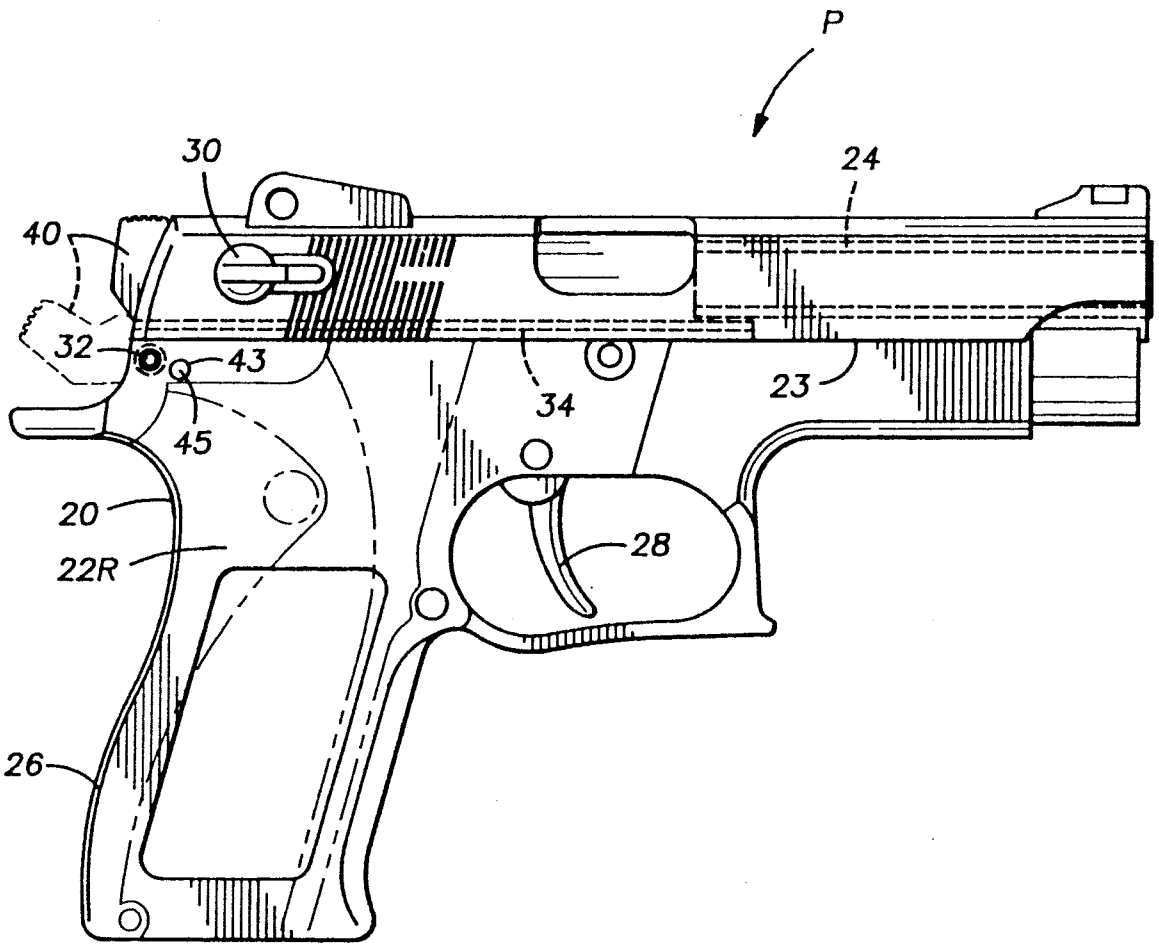
FIG. 1 is a side view of a semi-automatic pistol frame incorporating the present invention.

Referring now to FIG. 1, a semi-automatic pistol P frame is generally shown. In one embodiment of the present invention, the pistol P is a Smith & Wesson semi-automatic pistol. However, the incorporation of the present invention into other types of pistols is also contemplated. Many of the details of a pistol that are not relevant to the present invention have been omitted for the purpose of clarity. The pistol P includes a frame 20, side plates 22R and 22L (not shown—on opposite side of pistol), a barrel frame 23, a barrel 24, a firing pin (not shown), and a handle or grip 26 into which a magazine or cartridge holding apparatus (not shown) may be placed to provide cartridges to a chamber (not shown) in the pistol P. The pistol P also includes a pivotable cartridge striking hammer 40 rotatable about pin 45, which inserted into hole 43 drilled in side plate 22R, and is spring (not shown) biased within the frame 20 toward the barrel 24. The hammer 40 has a first (cocked) position against the spring bias and away from the barrel 24 (shown in phantom) preparatory to striking a cartridge (not shown) and a second (firing) position wherein it strikes a firing pin (not shown) to discharge a cartridge.

The pistol P includes a spring biased slide 34 which may be moved toward hammer 40 and returned to its original position in order to move the hammer 40 into its first (cocked) position and to supply cartridges to the pistol firing chamber. The pistol P also includes a trigger 28 for actuating the hammer 40. The trigger 28 releases the hammer 40 from its first (cocked) position and permits the spring bias to move the hammer 40 to its second (firing) position wherein it strikes the firing pin to discharge a cartridge through barrel 24. The pistol P also includes a safety locking mechanism 32 according to the present invention which is preferably inserted on the side plate 22R of the pistol P. The pistol P may also optionally include a safety latch 30 movable between a first "off" position wherein the hammer 40 is allowed to move between its first (cocked) and second (firing) positions, and a second "safe" position which retracts the hammer 40 from the firing pin to its first (cocked position and thereafter prevents movement of the hammer 40 to its second (firing) position.

Figure 2:
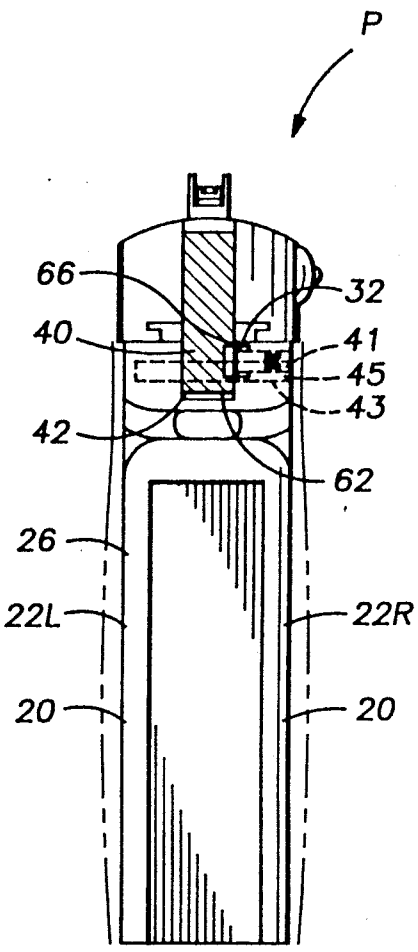
FIG. 2 is a rear view of the pistol of FIG. 1.
Figure 3B:
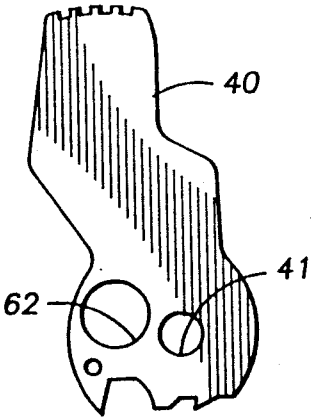
FIGS. 3A and 3B are side and rear views of the hammer of the pistol of FIG. 1.
Figure 3A:
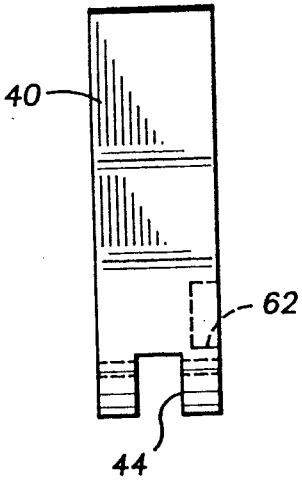

Referring now to FIGS. 2, 3A and 3B, a rear view of the pistol P and rear and side views of the hammer 40 respectively, are generally shown. The hammer 40 further has a pivot pin hole 41 passing therethrough. As seen in FIG. 2, the hammer 40 is inserted into the pistol frame 20. A pin 45 is inserted into side plate 22R hole 43 and passes through hammer 40 pivot hole 41. The hammer 40 is thus retained within the pistol P and pivots to its first and second about pin 45. Therefore, as shown in FIG. 1, the hammer 40 is moved into its first (cocked) position shown in phantom on FIG. 1 by rotating about pin 45 (FIG. 2) away from the barrel 24. The hammer 40 is moved to its second (firing) position by spring bias when activated by trigger 28, rotating about pin 45 (FIG. 2) toward the barrel 24 striking the firing pin and discharging a cartridge.

Referring again to FIG. 2, the installation of the safety locking apparatus 32 requires some minor modifications to the original parts of a premanufactured weapon. A hole 43 is drilled and tapped in the side plate 22R and/or frame 20 at adjacent to the hammer 40 and is also counterbored 64 on the inside face of side plate 22R. In one embodiment of the present invention, the hole 43 is threaded 8-32 and counterbore 64 is at a 0.187" diameter and is 0.06" deep on the inside face 66 of side plate 22R. However, the use of other specifications to drill the hole 43 according to the present invention is also contemplated. In addition, as shown in FIGS. 2, 3A and 3B, a blind hole 62 is drilled in the hammer 40 such that the hole 43 in side plate 22R is adjacent to and co-axial with the blind hole 62 in the side of hammer 40 when hammer 40 is in its second, closed position.

If the pistol P includes a safety latch 30, then preferably the safety latch 30 is moved to its "safe" position, which retracts the hammer 40 away from the firing pin, before the locking apparatus according to the present invention is activated. In this instance, the retraction of the hammer 40 caused by the operation of the safety latch 30 needs to be taken into account when determining the predetermined location of the blind hole 62 in the hammer 40 so that the safety locking mechanism 32 mates correctly with the blind hole 62 when in the locked position.

Figure 4:
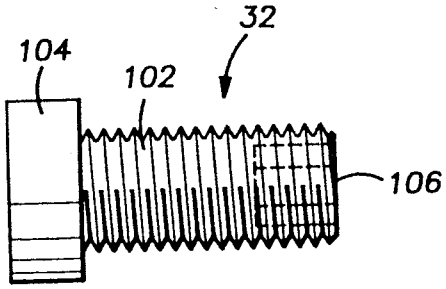
FIG. 4 is a side view of the safety locking apparatus of the present invention.

Referring now to FIG. 4, the safety locking mechanism 32 is comprised of a set screw 102 having a thread mating with the thread in hole 43 (not shown) in the side plate 22R which can be actuated by a selected drive or locking means (not shown) which is adapted to mate with the socket 106 of the screw 32. The drive means may include an allen wrench drive, star drive, phillips drive or other means of rotating set screw 102. Attached to the end of the screw 102 is a flat cylindrical button 104 which is adapted to mate flush within blind hole 62 formed in the hammer 40 when activated. The flat cylindrical button 104 is attached to the set screw preferably by a mechanical means such as welding. In an alternative embodiment of the present invention, the set screw 102 and the flat cylindrical button 104 are a unitary piece. Further, while the present embodiment contemplates a cylindrical button 104 co-axial with the set screw 102, it is understood that other locking means which are non-coaxial with screw 102 may be used.

Referring again to FIG. 2, the safety locking apparatus 32 is threaded into the hole 43 in the side plate 22R and/or frame 20 from the inside face 66 of the plate 22R and the pistol is reassembled. The selected drive means (not shown), which is adapted to mate with the socket 106 of the safety locking apparatus 32, is thereafter used to rotate the locking apparatus 32.

Figure 5:
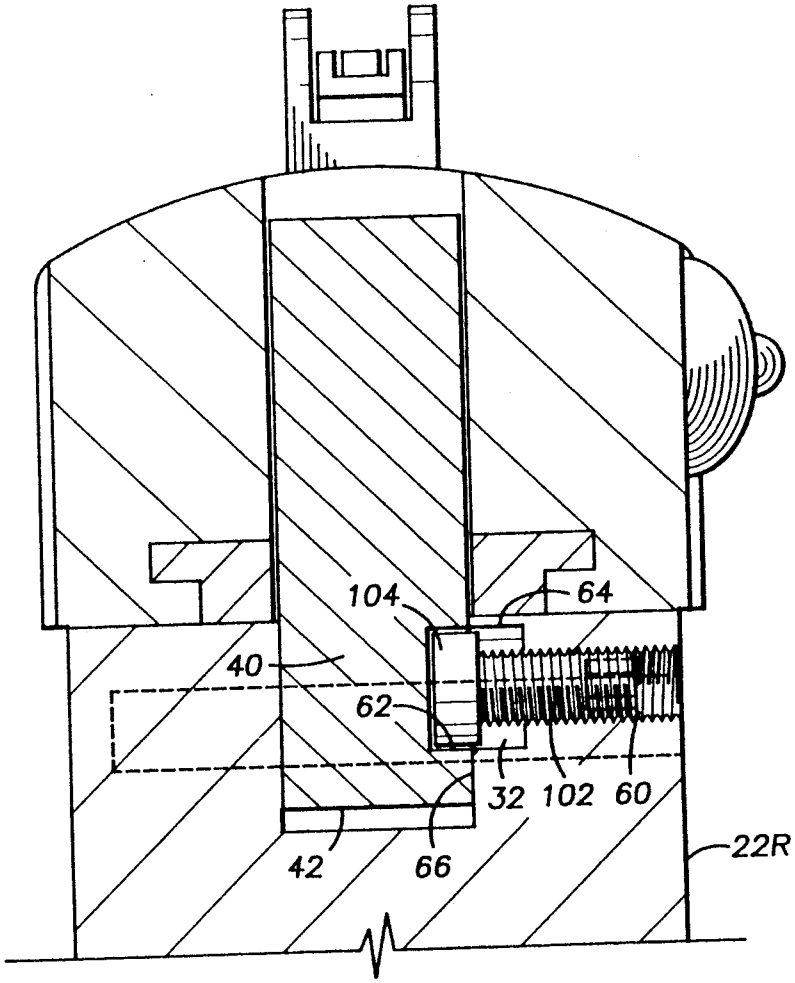
FIG. 5 is a side view of the safety locking apparatus in its locked position according to the present invention.

Referring now to FIG. 5, the hammer 40, which is shown shaded in the diagram for clarity, is shown situated in the notch 42 of the frame 20 of the pistol P, and the safety locking apparatus 32 is shown extended into its locked position such that the flat cylindrical button 104 is extended into the blind hole 62 formed in the hammer 40. The blind hole 62 that is formed in the hammer 40 is adapted to mate with the flat cylindrical button 104 when the hammer 40 and the flat cylindrical button 104 are brought into contact. When the safety locking apparatus 32 is installed and is turned clockwise to a "locked" position such that it can no longer be turned by the selected drive means, the flat cylindrical button 104 is extended into the blind hole 62 of the hammer 26 and acts as a hammer lock, thus preventing pivotal movement of the hammer 40 about its axis 41 and, consequently, preventing the trigger 28 and the slide 34 from operating.

Therefore, the safety locking apparatus 32 operates as follows. If the pistol P includes a safety latch 30, the safety latch 30 is first preferably moved to the "safe" position, which retracts the hammer 40 from the firing pin to a non-engaged position between its first and second positions. The safety looking apparatus 32 is then turned clockwise to a "locked" position, which extends the flat button 104 into the blind hole 62 of the hammer 40, thereby preventing further pivotal movement of the hammer 40. This consequently locks the trigger 28 and the slide 34 into place. When the safety locking mechanism 100 is turned counterclockwise to an "unlocked" position, the flat button 104 is retracted from the blind hole 62 inside the hammer 40 to the counterface 64 formed in the inside plate 66 of the side plate 22R, and the pistol P functions as originally intended by the manufacturer. Thus, the present invention virtually disables the weapon when in the locked position. The selected drive means is required to move the safety locking apparatus between the "locked" and "unlocked" positions, thereby rendering the weapon virtually childproof in the "locked" position. Furthermore, the addition of the present invention to a premanufactured weapon requires minimal modification to the weapon.

The description given here is intended to illustrate the preferred embodiment of this invention. It is possible to make various changes to the details of the apparatus without departing from this invention. It is intended that all such variations be included within the following claims.

I claim:

1. A safety locking apparatus for locking a hammer, a trigger and a slide of a semi-automatic handgun, the handgun having frame side plates, each side plate having an internal and an external face, a trigger having a first position and a second firing position, wherein the trigger is biased towards the first position, a pivotable cartridge striking hammer having a first cocked position and a second firing position, wherein the pivotal striking hammer is biased toward the firing position and is activated from the first cocked position to the second firing position by the trigger, and a slide means for placing the cartridge striking hammer int he second cocked position, comprising:

an internal locking means having a first unlocked position permitting operation of the hammer and the trigger, and a second locked position which engages the hammer, preventing pivotal movement of the hammer consequently locking the trigger and preventing movement of the slide, wherein said locking means comprises:

the handgun side plate having a drilled and tapped hole therethrough, the side plate further having a counterbore coaxial with the said drilled and tapped hole on the internal face of the side plate; and a hammer locking means adapted to fit within the pistol side plate hole, the hammer further having a blind hole coaxial with and adjacent to said side plate hole when the hammer is in its second position, said hammer blind hole adapted to receive said hammer locking means; and a means for engaging said internal locking means for placing said internal locking means in either said first or said second position, said engaging means being external to and removable from the handgun.

2. The safety locking apparatus of claim 1, wherein the hammer locking means includes:

a threaded set screw having a first and a second end, the first end, including a selected drive means, said set screw threads adapted to mate with said threads in said side plate hole, said drive means adapted to mate with said engaging means; and a locking means affixed to said second end of said set screw, said locking means adapted to fit into said hammer blind hole when said internal locking means is in its second locked position and adapted to fit flush within said side plate counterbore when said internal locking means is in its first unlocked position thereby permitting normal operation of the handgun.

3. The safety locking apparatus of claim 2, wherein said locking means comprises a flat cylindrical button affixed concentrically to said second end of said set screw.

* * * * *